US009744540B2

(12) United States Patent
Teele et al.

(10) Patent No.: US 9,744,540 B2
(45) Date of Patent: Aug. 29, 2017

(54) WATER INJECTOR NOZZLE

(71) Applicant: Dresser, Inc., Houston, TX (US)

(72) Inventors: Robert William Teele, Norwood, MA (US); Peter Kip Merrill, Raynham, MA (US)

(73) Assignee: Dresser, Inc., Addison, TX (US)

( * ) Notice: Subject to any disclaimer, the term of this patent is extended or adjusted under 35 U.S.C. 154(b) by 101 days.

(21) Appl. No.: 14/691,774

(22) Filed: Apr. 21, 2015

(65) Prior Publication Data

US 2016/0310973 A1 Oct. 27, 2016

(51) Int. Cl.
*B05B 1/32* (2006.01)
*B05B 1/30* (2006.01)

(52) U.S. Cl.
CPC ..... *B05B 1/32* (2013.01); *B05B 1/3006* (2013.01); *B05B 1/3073* (2013.01)

(58) Field of Classification Search
CPC ..... B05B 1/32; B05B 1/3073; B05B 1/3006
See application file for complete search history.

(56) References Cited

U.S. PATENT DOCUMENTS 2,527,950 A * 10/1950 Maness ..... B05B 1/3073 239/456
2,560,278 A * 7/1951 Curtis ..... B05B 1/12 239/458
2,921,746 A * 1/1960 Burman ..... B05B 1/32 239/453
2,991,942 A * 7/1961 Rosenkranz ..... B05B 1/3073 239/251
3,243,127 A 3/1966 Watson
3,756,516 A * 9/1973 Trnka ..... B05B 1/3073 239/456
3,893,624 A * 7/1975 Thompson ..... A62C 31/02 239/107
5,361,578 A 11/1994 Donlan
(Continued)

FOREIGN PATENT DOCUMENTS

GB 2300136 A 10/1996
WO WO 8200603 A1 * 3/1982 ..... B05B 1/265
WO 2004012969 A1 2/2004

OTHER PUBLICATIONS

International Search Report and Written Opinion issued in connection with corresponding PCT Application No. PCT/US16/23936 on Jul. 22, 2016.

*Primary Examiner* — Arthur O Hall
*Assistant Examiner* — Steven M Cernoch
(74) *Attorney, Agent, or Firm* — Paul Frank + Collins P.C.

(57) ABSTRACT

A water injector assembly includes an injector body having a substantially hollow interior. The injector body defines an inlet opening defined within an outer radial surface of the injector body at a first axial location along the injector body. The injector body defines a flowpath opening in fluid communication with the inlet opening such that the flowpath opening is configured to receive the fluid from the inlet opening. The injector body defines an outlet opening defined within the injector body at a second axial location along the injector body. The outlet opening is in fluid communication with the flowpath opening, such that the outlet opening receives the fluid from the flowpath opening. The second axial location of the outlet opening is different than the first axial location of the inlet opening.

21 Claims, 4 Drawing Sheets

(56) References Cited

U.S. PATENT DOCUMENTS

| | | | | |
|---|---|---|---|---|
| 6,042,028 | A * | 3/2000 | Xu | B05B 1/3073 239/461 |
| 6,370,862 | B1 | 4/2002 | Cheng | |
| 6,592,057 | B1 * | 7/2003 | Ericksen | B05B 1/3073 239/525 |
| 6,619,568 | B2 * | 9/2003 | Kunkle | B05B 1/3006 239/321 |
| 8,955,773 | B2 * | 2/2015 | Watson | F22G 5/123 137/542 |
| 9,016,530 | B2 * | 4/2015 | Topf | B05C 5/0225 137/15.18 |
| 2002/0179739 | A1 * | 12/2002 | Kunkle | B05B 1/3006 239/453 |
| 2005/0236496 | A1 | 10/2005 | Lasebnick | |
| 2014/0091486 | A1 * | 4/2014 | Watson | F22G 5/123 261/66 |

* cited by examiner

WATER INJECTOR NOZZLE

BACKGROUND OF THE INVENTION

Field of the Invention

The instant application is generally directed towards an injector nozzle and, in particular, is directed towards a water injector nozzle having a reduced cross-sectional size.

Discussion of the Prior Art

Water injector assemblies can be used to inject water into a pipeline, for example. In past examples, the water injector assemblies had a spray head that was movable between an opened position and a closed position. In the opened position, water could exit the water injector assembly by moving past the spray head and into the pipeline. To support the water injector assembly in place with respect to the pipeline, a plurality of bolts are used. In past examples, a total of six bolts have been used. Due to the environment within which the water injector assembly is used, the bolts have been made of an INCONEL® material (nickel based alloys; alloys containing nickel, chromium, iron, etc.), which is relatively strong, resistant to corrosion, etc.

The cost of the six INCONEL bolts is relatively high due to the relatively high number of bolts used and the type of material (e.g., INCONEL) used in the bolts. However, using fewer than six bolts has been impractical due to a cross-sectional size of the water injector assembly and the forces and/or pressures that the water injector assembly is subject to. Thus, it would be useful to provide a water injector assembly that has a reduced cross-sectional size such that fewer bolts (e.g., less than six) can be used to support the water injector assembly in place with respect to the pipeline.

BRIEF DESCRIPTION OF THE INVENTION

The following summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

In an example, a water injector assembly includes an injector body having a substantially hollow interior. The injector body defines an inlet opening defined within an outer radial surface of the injector body at a first axial location along the injector body. The inlet opening has an inlet cross-sectional size and is configured to receive a fluid. The injector body defines a flowpath opening in fluid communication with the inlet opening such that the flowpath opening is configured to receive the fluid from the inlet opening. The flowpath opening extends axially within the injector body. The flowpath opening has a flowpath cross-sectional size that is different than the inlet cross-sectional size. The injector body defines an outlet opening defined within the injector body at a second axial location along the injector body. The outlet opening is in fluid communication with the flowpath opening, such that the outlet opening is configured to receive the fluid from the flowpath opening. The second axial location of the outlet opening is different than the first axial location of the inlet opening.

In another example, a water injector assembly includes an injector body having a substantially hollow interior. The injector body defines an inlet opening defined within an outer radial surface of the injector body at a first axial location along the injector body. The inlet opening is configured to receive a fluid. The injector body defines a flowpath opening in fluid communication with the inlet opening such that the flowpath opening is configured to receive the fluid from the inlet opening. The injector body defines an outlet opening defined within the injector body at a second axial location along the injector body. The outlet opening is in fluid communication with the flowpath opening, such that the outlet opening is configured to receive the fluid from the flowpath opening. The water injector assembly includes a spray control assembly disposed at least partially within the hollow interior of the injector body. The spray control assembly is configured to control a passage of the fluid from the outlet opening and through an exit opening defined within the injector body. The spray control assembly includes a spray head disposed within the exit opening. The spray control assembly includes a shaft attached to the spray head and extending within the hollow interior of the injector body. The spray control assembly includes a biasing device operatively attached to the shaft and configured to bias the spray control assembly towards a closed position. The biasing device is at a third axial location along the injector body. The first axial location is located axially between the second axial location and the third axial location.

In another example, a water injector assembly includes an injector body having a substantially hollow interior. The injector body extends between a first end and a second end. The injector body defines an inlet opening defined within an outer radial surface of the injector body at a first axial location along the injector body that is a first distance from the first end. The inlet opening is configured to receive fluid. The injector body defines a flowpath opening in fluid communication with the inlet opening such that the flowpath opening is configured to receive the fluid from the inlet opening. The injector body defines an outlet opening defined within the injector body. The outlet opening is in fluid communication with the flowpath opening, such that the outlet opening is configured to receive the fluid from the flowpath opening. The injector body includes a spray control assembly disposed at least partially within the hollow interior of the injector body. The spray control assembly is configured to control a passage of the fluid from the outlet opening and through an exit opening defined within the injector body at the first end. The spray control assembly includes a spray head disposed within the exit opening at the first end of the injector body. The spray control assembly includes a shaft attached to the spray head and extending within the hollow interior of the injector body. The spray control assembly includes a biasing device operatively attached to the shaft and configured to bias the spray control assembly towards a closed position. The biasing device is at a third axial location along the injector body that is a third distance from the first end. The first distance is less than the second distance.

The following description and annexed drawings set forth certain illustrative aspects and implementations. These are indicative of but a few of the various ways in which one or more aspects can be employed. Other aspects, advantages, and/or novel features of the disclosure will become apparent from the following detailed description when considered in conjunction with the annexed drawings.

BRIEF DESCRIPTION OF THE DRAWING

The foregoing and other aspects of the present invention will become apparent to those skilled in the art to which the present invention relates upon reading the following description with reference to the accompanying drawings, in which.

DETAILED DESCRIPTION OF THE INVENTION

Figure 1:
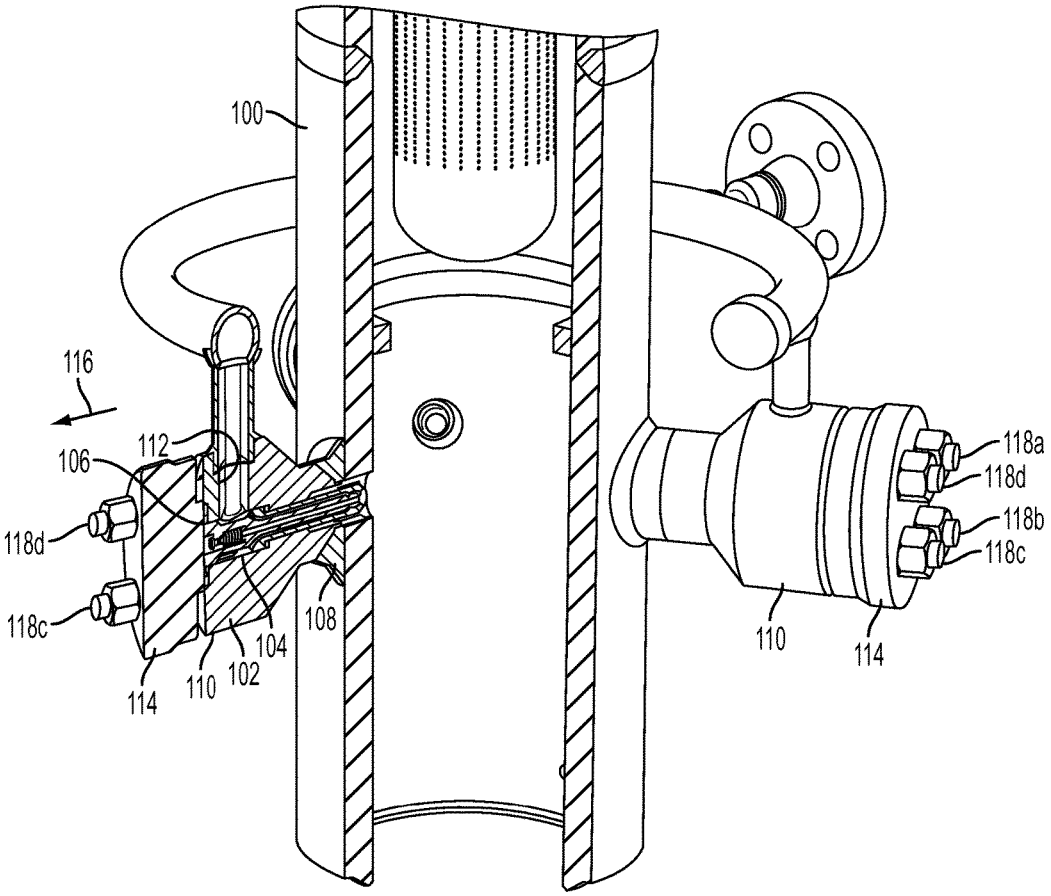
FIG. 1 is a partially sectioned illustration of an example water injector assembly attached to an example pipeline.

Example embodiments that incorporate one or more aspects of the disclosure are described and illustrated in the drawings. These illustrated examples are not intended to be a limitation on the disclosure. For example, one or more aspects can be utilized in other embodiments and even other types of devices. Moreover, certain terminology is used herein for convenience only and is not to be taken as a limitation. Still further, in the drawings, the same reference numerals are employed for designating the same elements.

Turning to FIG. 1, a portion of an example pipeline 100 is illustrated. The pipeline 100 can be used in any number of different environments, including oil and gas environments, for example. It will be appreciated that the pipeline 100 is illustrated somewhat schematically and sectioned off so as to illustrate portions of the pipeline 100 that may normally not be visible. In operation, however, the pipeline 100 can be closed off and fully formed. In some examples, the pipeline 100 can be in fluid communication with a turbine, a turbine bypass valve, a high pressure steam line, etc.

An injector housing 102 can be positioned adjacent an outer wall of the pipeline 100. The injector housing 102 includes a housing interior 104 that is substantially hollow into which a water injector assembly 106 can be received. The injector housing 102 extends between a first end 108 and a second end 110. In an example, the first end 108 of the injector housing 102 is positioned adjacent to, in contact with, attached to, etc. the outer wall of the pipeline 100. The second end 110 of the injector housing 102 is positioned a distance away from the first end 108.

In an example, the injector housing 102 defines a housing opening 112 that projects substantially perpendicularly to a direction of extension of the injector housing 102. The injector housing 102 can be attached to a supply device (e.g., supply line, etc.) that is attached to and in fluid communication with the housing opening 112. As such, the supply device can supply a fluid (e.g., liquid, water, gas, steam, etc.) through the housing opening 112 and into the housing interior 104.

An attachment structure 114 can be positioned adjacent the second end 110 of the injector housing 102. In this example, a cross-sectional size (e.g., diameter) of the attachment structure 114 may be substantially equal to a cross-sectional size (e.g., diameter) of the second end 110 of the injector housing 102. The attachment structure 114 can be in contact with the injector housing 102 and the water injector assembly 106 so as to limit unintended movement of the water injector assembly 106 in a first direction 116.

The attachment structure 114 can receive one or more fasteners 118 that can attach the attachment structure 114 to the injector housing 102. In an example, the fasteners 118 include screws, bolts, nuts, or other similar mechanical fasteners. The fasteners 118 can extend through the attachment structure 114 (e.g., through openings defined within the attachment structure 114) and can be attached to (e.g., threaded into, threadingly attached, etc.) the second end 110 of the injector housing 102. In this example, four fasteners 118 are provided (e.g., a first fastener 118*a*, a second fastener 118*b*, a third fastener 118*c*, and a fourth fastener 118*d*). As will be described below, due to a cross-sectional size of the water injector assembly 106, four fasteners 118 can be provided for attaching the attachment structure 114 to the injector housing 102. In this example, the four fasteners 118 provide sufficient attachment force to resist movement of the water injector assembly 106 in the first direction 116.

Figure 2:
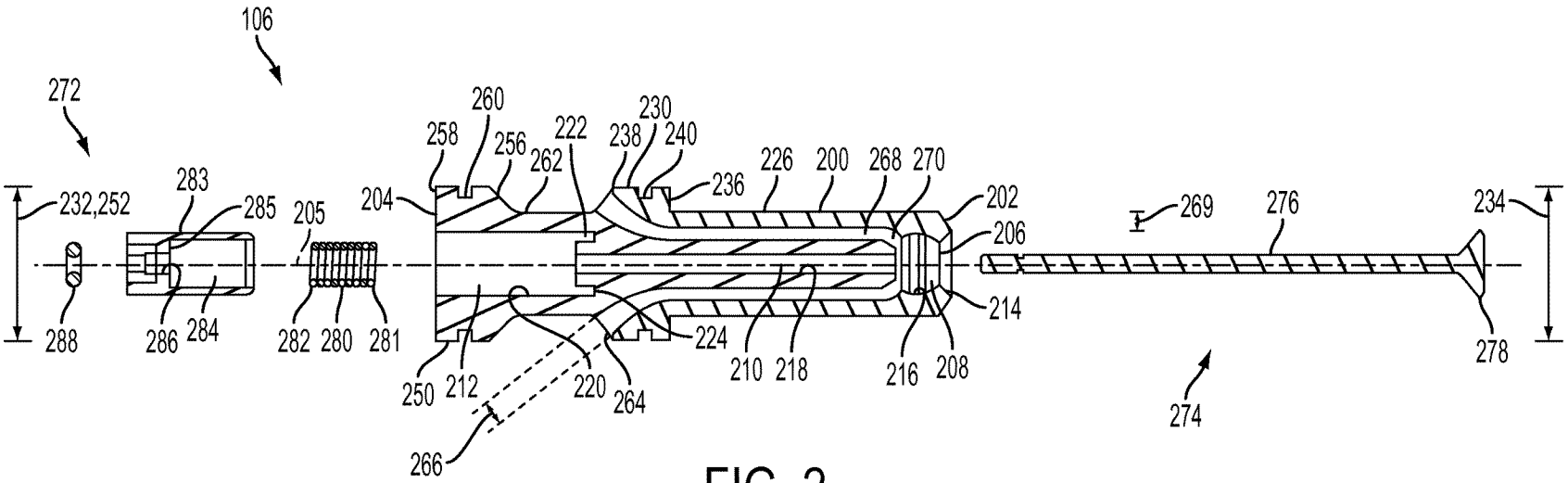
FIG. 2 is an enlarged, partially exploded sectional illustration of the example water injector assembly of FIG. 1.

Turning to FIG. 2, a sectional, partially exploded view of the water injector assembly 106 is illustrated. It will be appreciated that the water injector assembly 106 is illustrated as being sectioned off for illustrative purposes and to more clearly show interior portions of the water injector assembly 106 that may normally not be visible. Likewise, it will be appreciated that the water injector assembly 106 is illustrated as being partially exploded so as to show individual portions of the water injector assembly 106. In operation, the water injector assembly 106 may be fully assembled, in a manner similar to the example illustrated in FIG. 1.

The water injector assembly 106 includes an injector body 200. The injector body 200 extends between a first end 202 and a second end 204 along an axis 205. In an example, the first end 202 of the injector body 200 can be positioned adjacent an opening in the outer wall of the pipeline 100. The second end 204 of the injector body 200 can be positioned adjacent and/or in contact with the attachment structure 114. As such, the second end 204 of the injector body 200 can be aligned with and in proximity to the second end 110 of the injector housing 102. The injector body 200 can be formed in any number of ways. In one possible example, the injector body 200 can be formed from an additive manufacturing process (e.g., build up in layers by depositing material).

The injector body 200 can have a substantially hollow interior 206. In an example, the hollow interior 206 extends between the first end 202 and the second end 204 of the injector body 200. The hollow interior 206 may be sized and/or shaped to receive one or more structures therein. In some examples, the hollow interior 206 can have a non-constant cross-sectional size between the first end 202 and the second end 204. For example, the hollow interior 206 can have a varying cross-sectional size (e.g., becoming larger or smaller) from the first end 202 to the second end 204 of the injector body 200.

The hollow interior 206 defines a first interior portion 208, a second interior portion 210, and a third interior portion 212. The first interior portion 208 is positioned adjacent to the first end 202 of the injector body 200. The first interior portion 208 is in fluid communication with an exit opening 214 defined within the first end 202 of the injector body 200. As such, fluids, such as liquids, steam, gases, etc., can selectively flow from the first interior portion 208 and through the exit opening 214. In this example, the first interior portion 208 is defined by one or more first interior walls 216. The first interior wall 216 is substantially rounded and/or curved, such that the first interior portion 208 has an ovoid shape, a truncated ovoid shape, a spherical shape, a truncated spherical shape, etc.

The hollow interior 206 defines the second interior portion 210. The second interior portion 210 can be in fluid communication with the first interior portion 208. The second interior portion 210 is located between the first end 202 and the second end 204 of the injector body 200, with the second interior portion 210 positioned adjacent the first interior portion 208. In an example, the second interior portion 210 is located in closer proximity to the second end 204 of the injector body 200 than the first interior portion 208.

The second interior portion 210 is defined by one or more second interior walls 218. The second interior wall 218 can extend substantially parallel to and substantially coaxial with respect to the axis 205. In this example, the second interior wall 218 defines a cylindrical shape that extends along the axis 205. As such, the second interior portion 210 can have a substantially constant cross-sectional size along a length of the second interior portion 210.

The hollow interior 206 defines the third interior portion 212. The third interior portion 212 can be in fluid communication with the second interior portion 210. The third interior portion 212 is located between the first end 202 and the second end 204 of the injector body 200, with the third interior portion 212 positioned adjacent the second interior portion 210. In an example, the third interior portion 212 is located in closer proximity to the second end 204 of the injector body 200 than the first interior portion 208 or the second interior portion 210. As such, the second interior portion 210 is located between the first interior portion 208 and the third interior portion 212.

The third interior portion 212 is defined by one or more third interior walls 220. The third interior wall 220 can extend substantially parallel to and coaxial with respect to the axis 205. In this example, the third interior wall 220 defines a cylindrical shape that extends along the axis 205. As such, the third interior portion 212 can have a substantially constant cross-sectional size along a length of the third interior portion 212. In this example, the third interior wall 220 extends substantially parallel to and coaxial with the second interior wall 218. The third interior portion 212 can have a larger cross-sectional size than the second interior portion 210, such that the third interior wall 220 is located radially outward from (e.g., a larger radial distance from the axis 205) the second interior wall 218.

The third interior wall 220 can be radially separated from the second interior wall 218 to define an engagement opening 222. The engagement opening 222 is disposed radially between an end of the second interior wall 218 and an end of the third interior wall 220. The engagement opening 222 can further be defined by a fourth interior wall 224 that extends radially between the second interior wall 218 and the third interior wall 220. As such, the engagement opening 222 is bounded on three sides by the second interior wall 218, the third interior wall 220, and the fourth interior wall 224.

Referring now to an outer radial surface 226 of the water injector assembly 106, the water injector assembly 106 includes a first engagement portion 230. The first engagement portion 230 defines a first engagement cross-sectional size 232. In this example, the first engagement cross-sectional size 232 is larger than an injector cross-sectional size 234 of the injector body 200 from the first end 202 of the injector body 200 to the first engagement portion 230. The first engagement portion 230 has a first side 236 and a second side 238. In this example, the first side 236 extends substantially perpendicularly with respect to the injector body 200. The second side 238 can have a sloped and/or angled shape that may extend non-perpendicularly with respect to the injector body 200.

The first engagement portion 230 can define a first engagement channel 240 that extends radially around the first engagement portion 230. The first engagement channel 240 is open radially outwardly, such that the first engagement channel 240 defines a recess, furrow, trench, etc. As such, the first engagement channel 240 can receive a gasket, O-ring, or other elastomeric and/or compressible structure. In addition or in the alternative, a gasket, O-ring, other elastomeric and/or compressible structure can be positioned adjacent the first side 236 of the first engagement portion 230. In these examples, the gasket, O-ring, etc. can contact and/or engage the injector housing 102 (e.g., walls and/or surfaces within the housing interior 104) so as to form a seal between the water injector assembly 106 and the injector housing 102.

The water injector assembly 106 includes a second engagement portion 250. The second engagement portion 250 defines a second engagement cross-sectional size 252. In this example, the second engagement cross-sectional size 252 is larger than the injector cross-sectional size 234. In an example, the second engagement cross-sectional size 252 may be the same size as the first engagement cross-sectional size 232. The second engagement portion 252 has a first side 256 and a second side 258. In this example, the first side 256 has a sloped and/or angled shape that may extend non-perpendicularly with respect to the injector body 200. The second side 258 may extend substantially perpendicularly with respect to the injector body 200.

The second engagement portion 250 can define a second engagement channel 260 that extends radially around the second engagement portion 250. The second engagement channel 260 is open radially outwardly, such that the second engagement channel 260 defines a recess, furrow, trench, etc. As such, the second engagement channel 260 can receive a gasket, O-ring, or other elastomeric and/or compressible structure. In addition or in the alternative, a gasket, O-ring, other elastomeric and/or compressible structure can be positioned adjacent the second side 258 of the second engagement channel 260. In these examples, the gasket, O-ring, etc. can contact and/or engage the injector housing 102 (e.g., walls and/or surfaces within the housing interior 104) and/or the attachment structure 114 so as to form a seal between the water injector assembly 106, the injector housing 102, and/or the attachment structure 114.

The first engagement portion 230 and the second engagement portion 250 can be spaced apart from each other axially along the injector body 200. In an example, a chamber 262 may be defined between the first engagement portion 230 and the second engagement portion 250. The chamber 262 can be axially aligned with the housing opening 112, such that the chamber 262 can receive a fluid (e.g., liquid, water, gas, etc.) from the housing opening 112. The chamber 262 can define a chamber cross-sectional size that is reduced (e.g., less than) as compared to the first engagement cross-sectional size 232 and/or the second engagement cross-sectional size 252.

The injector body 200 can define one or more inlet openings 264 that are defined within the outer radial surface 226 of the injector body 200. It will be appreciated that while two inlet openings 264 are illustrated in FIG. 2 (e.g., defined at the top and the bottom of the injector body 200), any number (e.g., one or more) of inlet openings 264 can be provided circumferentially around the injector body 200. In an example, the inlet openings 264 are defined at the second side 238 of the first engagement portion 230 adjacent to the chamber 262. As such, the inlet openings 264 can be positioned between the first engagement portion 230 and the second engagement portion 250. The inlet opening 264 can have an inlet cross-sectional size 266.

The inlet openings 264 define a path, a channel, or the like through which a fluid (e.g., liquid, water, gas, etc.) can pass from the housing opening 112, through the chamber 262, and into the inlet opening 264. As such, in an example, the inlet openings 264 can receive a fluid from the housing opening 112. In this example, the inlet openings 264 are angled with respect to the axis 205. For example, the inlet openings 264 can receive the fluid (e.g., liquid, water, gas, etc.) along an angle that is between about 30 degrees and about 60 degrees with respect to the axis 205.

The injector body 200 can define one or more flowpath openings 268. The flowpath openings 268 are in fluid communication with the inlet openings 264 such that the flowpath openings 268 can receive the fluid from the inlet openings 264. In an example, the flowpath opening 268 extends substantially axially within the injector body 200 along the axis 205. In this example, the flowpath opening 268 can extend between the inlet opening 264 at one end and the first end 202 of the injector body 200 at an opposing end. In this example, the flowpath openings 268 may extend axially along the injector body 200 at a location that is radially between the second interior portion 210 and the outer radial surface 226 of the injector body 200. The flowpath openings 268 can therefore be defined by the outer radial surface 226 of the injector body 200 (e.g., at an outer radial side) and by the second interior wall 218 at an inner radial side.

The flowpath openings 268 define a path, a channel or the like through which a fluid (e.g., liquid, water, gas, etc.) can pass from the inlet openings 264 and through the flowpath opening 268. The flowpath opening 268 has a flowpath cross-sectional size 269 that is different than the inlet cross-sectional size 266. For example, the flowpath cross-sectional size 269 may be less than the inlet cross-sectional size 266.

The injector body 200 can define one or more outlet openings 270. The outlet openings 270 are in fluid communication with the flowpath openings 268 such that the outlet openings 270 can receive the fluid from the flowpath openings 268. In an example, the outlet openings 270 are located at an end of the flowpath openings 268 opposite the inlet openings 264. That is, the inlet openings 264 may be located at an upstream end of the flowpath openings 268 while the outlet openings 270 may be located at an opposing downstream end of the flowpath openings 268. As such, the outlet openings 270 are in fluid communication with the flowpath openings 268 and with the hollow interior 206 (e.g., the first interior portion 208) of the injector body 200.

In the illustrated examples, the holes (e.g., as defined by the inlet openings 264, the flowpath openings 268, and the outlet openings 270) can have a non-linear shape along the injector body 200. For example, the inlet openings 264 can extend in a direction that is non-parallel with respect to the axis 205. Likewise, the inlet openings 264 can have a non-uniform cross-sectional size, such as by having a trumpet shape (e.g., decreasing cross-sectional size from an end (e.g., a left end) of the inlet opening 264 to an opposing end (e.g., a right end)). In this example, the flowpath openings 268 can extend substantially parallel with respect to the axis 205. In this example, the outlet openings 270 can extend in a direction that is non-parallel with respect to the axis 205. This shape allows for the holes to compactly fit into a smaller injector body 200 (e.g., smaller cross-sectional size/diameter).

The water injector assembly 106 includes a spray control assembly 272. The spray control assembly 272 can control the passage of the fluid from the outlet opening 270 and through the exit opening 214 that is defined within the injector body 200. The spray control assembly 272 is illustrated in a partially exploded state in FIG. 2. However, in operation, the spray control assembly 272 can be fully assembled, similar to the examples illustrated in FIGS. 1, 3 and 4.

The spray control assembly 272 includes a control structure 274. The control structure 274 is an elongated structure extending along the axis 205 that can be at least partially received within the hollow interior 206 of the injector body 200. In this example, the control structure 274 includes a shaft 276 that extends along the axis 205. The shaft 276 has a cross-sectional size that is less than a cross-sectional size (e.g., diameter) of the second interior portion 210. As such, the shaft 276 can be received at least partially within the first interior portion 208, the second interior portion 210, and the third interior portion 212.

The shaft 276 can extend along the injector body 200 substantially entirely between the first end 202 and the second end 204. In an example, the shaft 276 can have a shaft length that is greater than about one half (½) of a body length of the injector body 200. In another example, the shaft 276 can have a shaft length that is greater than about two thirds (⅔) of a body length of the injector body 200. In yet another example, the shaft 276 can have a shaft length that is greater than about three fourths (¾) of a body length of the injector body 200. In this example, the shaft 276 can extend through the first interior portion 208, through the second interior portion 210, and at least partially through the third interior portion 212.

The control structure 274 includes a spray head 278 attached to an end of the shaft 276. In an example, the spray head 278 may be disposed at least partially within the exit opening 214 of the injector body 200 when the shaft 276 is received within the first interior portion 208, the second interior portion 210, and the third interior portion 212. While the spray head 278 includes any number of shapes, in the illustrated example, the spray head 278 can have a truncated conical and/or a frusto-conical shape. A narrow portion of the spray head 278 can be attached to the shaft 276 such that the spray head 278 increases in cross-sectional size in a direction away from the shaft 276 (e.g., from left to right in FIG. 2). A cross-sectional size of the spray head 278 can be substantially equal to or greater than a cross-sectional size of the exit opening 214, such that the spray head 278 can selectively contact the first interior wall 216 to close, seal, block, etc. the exit opening 214.

The spray control assembly 272 includes a biasing device 280. As will be described herein, the biasing device 280 can be operatively attached to the shaft 276 and can bias the spray control assembly 272 (e.g., the spray head 278) towards a closed position. In the closed position, the spray head 278 can contact the first interior wall 216 to close, seal, block, etc. the exit opening 214. The biasing device 280 includes any number of structures that has at least some degree of flexibility, compressibility, or the like. In one possible example, the biasing device 280 may include a spring, such as compression spring.

A cross-sectional size of the biasing device 280 can be less than a cross-sectional size of the third interior portion 212, such that the biasing device 280 can be received within the third interior portion 212. The biasing device 280 extends between a first end 281 and a second end 282. In an example, the first end 281 of the biasing device 280 can contact and/or engage the second interior wall 218. The biasing device 280 can be substantially hollow so as to define a channel, opening, etc. extending through the biasing device 280 between the first end 281 and the second end 282. This opening in the biasing device 280 can be substantially coaxial with the axis 205 such that opening in the biasing device 280 and the second interior portion 210 can extend end to end. In an example, the shaft 276 can extend through the biasing device 280.

The biasing device 280 can be received within a biasing housing 283. For example, the biasing device 280 can be received within an interior 284 of the biasing housing 283. In an example, the second end 282 of the biasing device 280 can bear against an internal wall 285 of the biasing device 280. The biasing housing 283 defines a shaft opening 286 that extends through the internal wall 285 of the biasing housing 283. In an example, the shaft opening 286 of the biasing device 280 is sized and shaped to receive the shaft 276.

The spray control assembly 272 can include a fastener 288. The fastener 288 includes any number of devices that can attach and/or removably attach to the shaft 276. In an example, the fastener 288 can include a threaded nut that can thread onto (e.g., attach to) an end of the shaft 276 that is opposite the spray head 278. In operation, the shaft 276 can pass through the shaft opening 286. As such, the fastener 288 attaches to the shaft 276 on an opposite side of the internal wall 285 from the biasing device 280.

Figure 3:
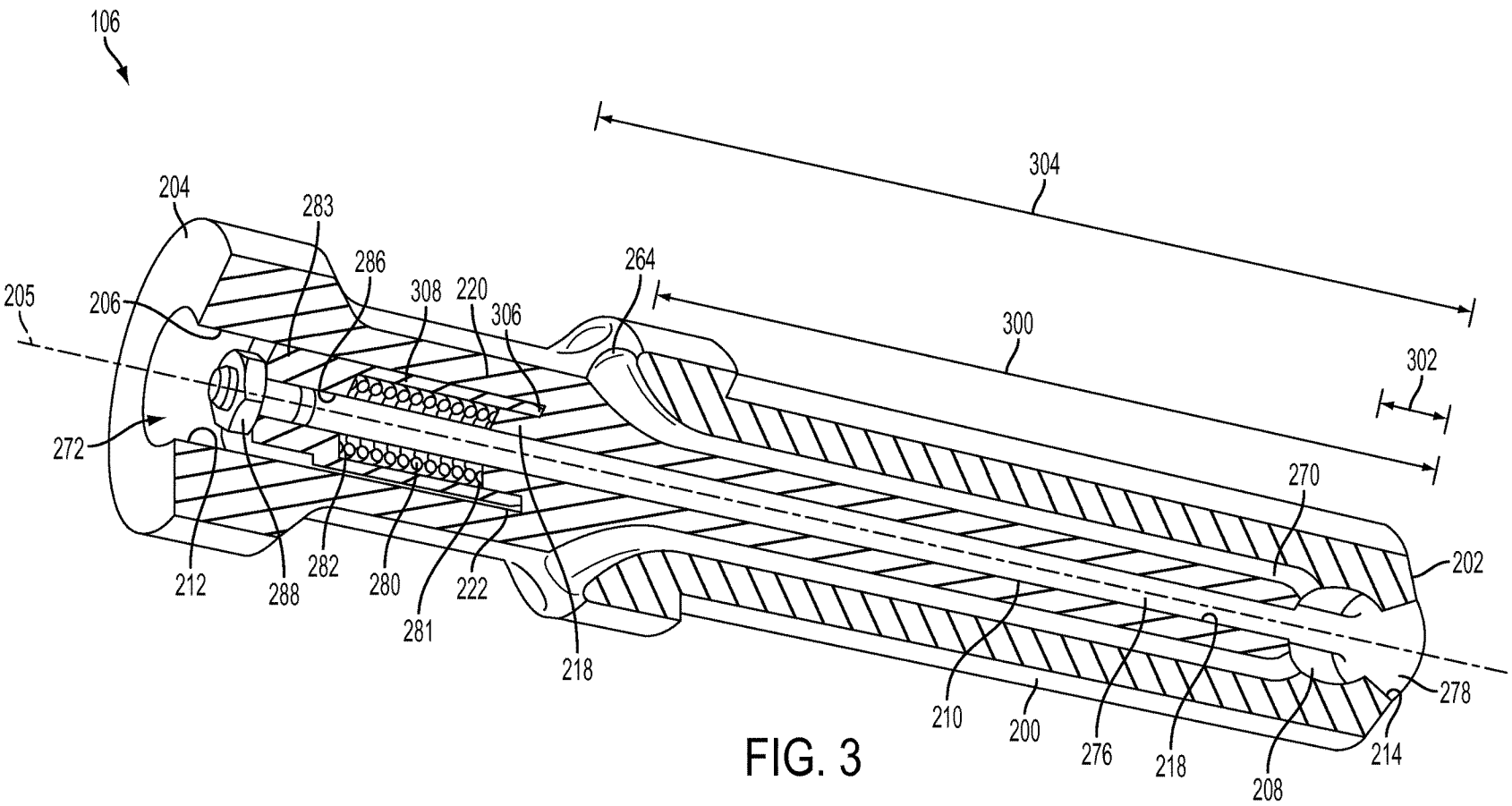
FIG. 3 is a further enlarged, sectional illustration of the example water injector assembly of FIG. 2.

Turning to FIG. 3, the water injector assembly 106 is illustrated in a fully assembled state. As illustrated, the inlet opening 264 is located at a first axial location along the injector body 200. In an example, the first axial location along the injector body 200 is a first distance 300 from the first end 202 of the injector body 200. The outlet opening 270 is located at a second axial location along the injector body 200. In an example, the second axial location along the injector body 200 is a second distance 302 from the first end 202 of the injector body 200. The second axial location of the outlet opening 270 is different than the first axial location of the inlet opening 264. For example, the second distance 302 may be less than the first distance 300.

The biasing device 280 (e.g., the first end 281) is located at a third axial location along the injector body 200. In an example, the third axial location along the injector body 200 is a third distance 304 from the first end 202 of the injector body 200. The first axial location of the inlet opening 264 is located axially between the second axial location of the outlet opening 270 and the third axial location of the biasing device 280. In the illustrated example, the first distance 300 is less than the third distance 304.

Referring to the spray control assembly 272, the spray control assembly 272 can be disposed at least partially within the hollow interior 206 of the injector body 200. In this example, the spray head 278 is disposed within the exit opening 214 so as to selectively close, seal, block, etc. the exit opening 214. The shaft 276 can extend from the spray head 278, through the first interior portion 208, through the second interior portion 210, and at least partially through the third interior portion 212. The shaft can extend through the biasing device 280 and through the shaft opening 286 of the biasing housing 283. The fastener 288 can be attached to the end of the shaft 276 so as to attach the shaft 276 with respect to the biasing housing 283. As such, movement of the biasing housing 283 can cause a corresponding movement (e.g., axial movement) of the shaft 276 along the axis 205.

The biasing device 280 can bias the spray control assembly 272 towards a closed position. In an example, an end 306 of a sidewall 308 of the biasing housing 283 can be at least partially disposed within the engagement opening 222. That is, the end 306 of the sidewall 308 is disposed between the second interior wall 218 and the third interior wall 220 within the engagement opening 222. The sidewall 308 can be movable within the engagement opening 222, such as in response to compression or extension of the biasing device 280.

Figure 4:
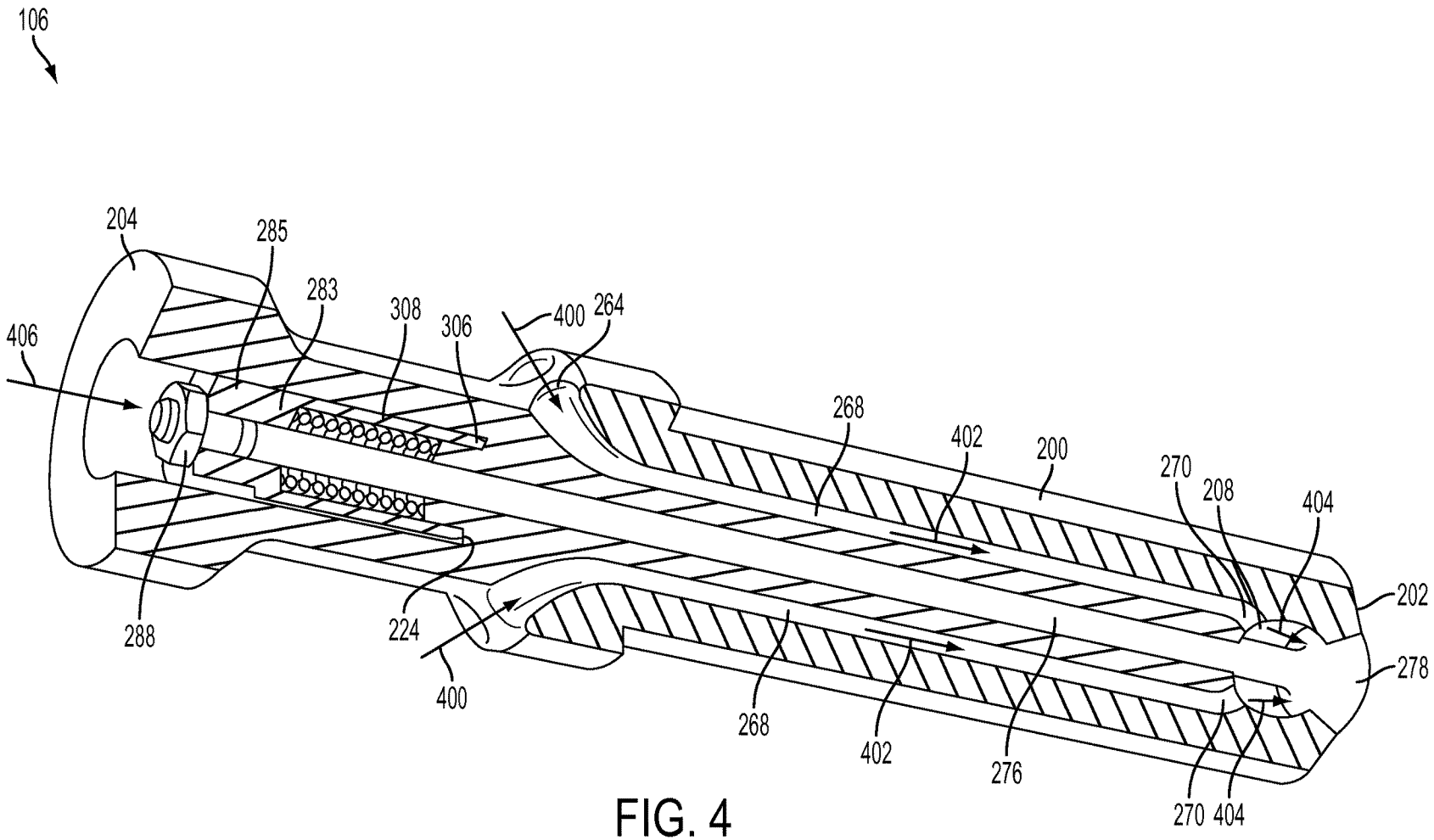
FIG. 4 is a sectional illustration of the example water injector assembly of FIG. 3.

Turning to FIG. 4, an example operation of the water injector assembly 106 is illustrated. In this example, fluid can flow/enter (e.g., illustrated schematically with arrowheads 400) the injector body 200 through the inlet openings 264. The fluid (e.g., liquid, water, gas, etc.) can flow through the housing opening 112 (e.g., illustrated in FIG. 1) and enter 400 the inlet openings 264. Upon entering the inlet openings 264, the fluid can flow 402 through the flowpath opening 268 away from the inlet opening 264. The fluid can then flow/exit 404 through the outlet opening 270, whereupon the fluid can enter the first interior portion 208 of the injector body 200.

The fluid in the first interior portion 208 can act upon the spray head 278 of the spray control assembly 272. In this example, the fluid, such as a result of pressure within the first interior portion 208, can cause the spray head 278 to move from the closed position to an opened position. When the spray head 278 moves from the closed position to the opened position, the shaft 276 can move (e.g., slide, translate, etc.) towards the first end 202 of the injector body 200 (e.g., from left to right in the illustrated example of FIG. 4). As the shaft 276 moves, the fastener 288 can likewise move towards the first end 202 of the injector body 200. The fastener 288 can act upon the internal wall 285 of the biasing housing 283, causing the biasing housing 283 to move 406 towards the first end 202 of the injector body 200.

Initially, when the spray head 278 is in the closed position, the end 306 of the sidewall 308 of the biasing housing 283 may be spaced a distance apart from the fourth interior wall 224. However, as the spray head 278 moves from the closed position to the opened position (e.g., from left to right in FIG. 4), the biasing housing 283 can likewise move towards the first end 202 of the injector body 200. As the biasing housing 283 moves (e.g., from left to right) towards the first end 202, the end 306 of the sidewall 308 can move towards and/or into contact with the fourth interior wall 224. This movement of the biasing housing 283 causes the biasing device 280 to compress.

The spray control assembly 272 can remain in the opened position at least as long as the fluid is flowing (e.g., 400, 402, 404) into the inlet opening 264, through the flowpath opening 268, and out of the outlet opening 270. Further, the fluid flows past the spray head 278 and out from the water injector assembly 106. It is to be appreciated that the spray head 278 may only move a relatively small distance (i.e., un-seat) away from the surface that defines the exit opening 214, and thus allow fluid flow through a relatively cross-sectional area (not readily seen within the FIG. 4) past the spray head 278. However, a relatively large fluid pressure may still provide for a relatively large volume of fluid movement past the spray head 278. The fluid may exit out from the assembly 106 as water vapor. The water vapor can be considered to be injected into the pipeline 100. Once the fluid stops flowing, the spray control assembly 272 can move back from the opened position to the closed position, whereupon the spray head 278 contacts and engages the surface that defines the exit opening 214 (i.e., re-seat).

Due to the biasing assembly (e.g., the biasing device 280, the biasing housing 283, etc.) being located between the second end 204 of the injector body 200 (e.g., opposite the exit opening 214) and the inlet opening 264, a cross-sectional size of the injector body 200 can be reduced. For example, the injector body 200 can include the inlet opening 264, the flowpath opening 268 and the outlet opening 270 defined within the injector body 200. Due to the biasing assembly (e.g., the biasing device 280, the biasing housing 283, etc.) being located closer to the second end 204, the inlet opening 264, the flowpath opening 268 and the outlet opening 270 can incorporate the illustrated shape.

In this example, the injector body 200 can be formed as part of an additive manufacturing process. For example, successive layers of the injector body 200 can be laid upon previously formed layers in response to computer control. As a result of this additive manufacturing process, the injector body 200 can include the inlet opening 264, the flowpath opening 268 and the outlet opening 270 having the illustrated size and shape. Additionally, the additive manufacturing process allows for a number of different materials (e.g., improved materials with respect to one or more of strength, weight, cost, corrosion resistance, etc.) to be used in forming the injector body 200, with some of these materials not being available under non-additive manufacturing techniques.

In this example, the water injector assembly 106, in particular the injector body 200, can have a reduced overall size as compared to past water injectors. For example, a length of the injector body 200 can be in a range of about 10 centimeters (e.g., 3.9 inches) to about 12 centimeters (e.g., 4.7 inches). In an example, a length of the injector body 200 is about 11.37 centimeters (e.g., 4.475 inches), which represents a 15% reduction in length as compared to past water injectors. As a result of this reduction in length, flow efficiency is increased since a length of the holes (e.g., as defined by the inlet openings 264, the flowpath openings 268, and the outlet openings 270) is likewise reduced, which causes a reduction in surface friction from the walls of the holes.

In this example, a maximum cross-sectional (e.g., diameter) size (e.g., the first engagement cross-sectional size 232 and/or the second engagement cross-sectional size 252) of the injector body 200 can be in a range of about 2.54 centimeters (e.g., 1 inch) to about 3.175 centimeters (e.g., 1.25 inches). In an example, a maximum cross-sectional size (e.g., the first engagement cross-sectional size 232 and/or the second engagement cross-sectional size 252) of the injector body 200 is about 3 centimeters (e.g., 1.185 inches), which represents a 21% reduction in maximum cross-sectional size as compared to past water injectors.

As a result of this reduced size, a reduced total number of fasteners 118 can be used to support the water injector assembly 106 with respect to the injector housing 102. In the illustrated example (e.g., as illustrated in FIG. 1), four fasteners 118 (e.g., 118*a*, 118*b*, 118*c*, 118*d*) can be used for supporting the water injector assembly 106 within the housing interior 104 of the injector housing 102. In past water injectors, a total of six fasteners were needed as a result of the increased size (e.g., length and/or cross-sectional size) of the water injectors. By reducing the number of fasteners 118, a total cost is reduced, as the fasteners are relatively expensive due to the INCONEL material (nickel based alloys; alloys containing nickel, chromium, iron, etc.) being used for the fasteners 118.

The invention has been described with reference to the example embodiments described above. Modifications and alterations will occur to others upon a reading and understanding of this specification. Example embodiments incorporating one or more aspects of the disclosure are intended to include all such modifications and alterations insofar as they come within the scope of the appended claims.

What is claimed is:

1. A water injector assembly, comprising:

an injector body having a longitudinal axis extending between a first end and a second end with a substantially hollow interior, the injector body defining:

engagement portions comprising a first engagement portion and a second engagement portion, the first engagement portion set longitudinally inwardly from the first end and closer to the second end than the first end, the second engagement portion spaced apart longitudinally from the first engagement portion toward the second end, the injector body having a diameter at the engagement portions that is larger than the diameter proximate the first end and forming an exterior groove that circumscribes the injector body at each of the first engagement portion and the second engagement portion;

an inlet opening disposed between the exterior groove of first engagement portion and the exterior groove of the second engagement portion, the inlet opening defined within an outer radial surface of the injector body, the inlet opening having an inlet cross-sectional size and being configured to receive a fluid;

a flowpath opening in fluid communication with the inlet opening such that the flowpath opening is configured to receive the fluid from the inlet opening, the flowpath opening extending axially within the injector body, the flowpath opening having a flowpath cross-sectional size that is different than the inlet cross-sectional size; and an outlet opening defined within the injector body at a second axial location along the injector body, the outlet opening in fluid communication with the flowpath opening, such that the outlet opening is configured to receive the fluid from the flowpath opening, wherein the second axial location of the outlet opening is different than the first axial location of the inlet opening, wherein the diameter of the injector body at the engagement portions is larger than the diameter of the injector body between the engagement portions.

2. The water injector assembly of claim 1, wherein the flowpath cross-sectional size is less than the inlet cross-sectional size.

3. The water injector assembly of claim 1, wherein the flowpath opening extends longitudinally within the injector body substantially parallel to the longitudinal axis.

4. The water injector assembly of claim 1, wherein the inlet opening extends into the injector body at an angle with respect to the longitudinal axis.

5. The water injector assembly of claim 4, wherein the angle is non-perpendicular with respect to the longitudinal axis.

6. The water injector assembly of claim 1, wherein the second axial location is disposed between the second engagement portion and the second end.

7. The water injector assembly of claim 1, wherein the first engagement portion forms a shoulder, and wherein the inlet opening is formed in the shoulder.

8. A water injector assembly comprising: an injector body having a longitudinal axis extending between a first end and a second end with a substantially hollow interior, the injector body defining: engagement portions comprising a first engagement portion and a second engagement portion, the first engagement portion set longitudinally inwardly from the first end and closer to the second end than the first end, the second engagement portion spaced apart longitudinally from the first engagement portion toward the second end, the injector body having a diameter at the engagement portions that is larger than the diameter proximate the first end and forming an exterior groove that circumscribes the injector body at each of the first engagement portion and the second engagement portion; an inlet opening disposed between the exterior groove of first engagement portion and the exterior groove of the second engagement portion, the inlet opening defined within an outer radial surface of the injector body, the inlet opening having an inlet cross-sectional size and being configured to receive a fluid; a flowpath opening in fluid communication with the inlet opening such that the flowpath opening is configured to receive the fluid from the inlet opening, the flowpath opening extending axially within the injector body, the flowpath opening having a flowpath cross-sectional size that is different than the inlet cross-sectional size; an outlet opening defined within the injector body at a second axial location along the injector body, the outlet opening in fluid communication with the flowpath opening, such that the outlet opening is configured to receive the fluid from the flowpath opening, wherein the second axial location of the outlet opening is different than the first axial location of the inlet opening; and a gasket disposed in the exterior groove of the first engagement portion, wherein the diameter of the injector body at the engagement portions is larger than the diameter of the injector body between the engagement portions.

9. The water injection assembly of claim 8, wherein the first engagement portion forms a shoulder, and wherein the inlet opening is formed in the shoulder.

10. The water injector assembly of claim 8, wherein the flowpath cross-sectional size is less than the inlet cross-sectional size.

11. The water injector assembly of claim 8, wherein the flowpath opening extends longitudinally within the injector body substantially parallel to the longitudinal axis.

12. The water injector assembly of claim 8, wherein the inlet opening extends into the injector body at an angle with respect to the longitudinal axis.

13. The water injector assembly of claim 12, wherein the angle is non-perpendicular with respect to the longitudinal axis.

14. The water injector assembly of claim 8, wherein the second axial location is disposed between the second engagement portion and the second end.

15. A water injector assembly comprising: an injector body having a longitudinal axis extending between a first end and a second end with a substantially hollow interior, the injector body defining: engagement portions comprising a first engagement portion and a second engagement portion, the first engagement portion set longitudinally inwardly from the first end and closer to the second end than the first end, the second engagement portion spaced apart longitudinally from the first engagement portion toward the second end, the injector body having a diameter at the engagement portions that is larger than the diameter proximate the first end and forming an exterior groove that circumscribes the injector body at each of the first engagement portion and the second engagement portion; an inlet opening disposed between the exterior groove of first engagement portion and the exterior groove of the second engagement portion, the inlet opening defined within an outer radial surface of the injector body, the inlet opening having an inlet cross-sectional size and being configured to receive a fluid; a flowpath opening in fluid communication with the inlet opening such that the flowpath opening is configured to receive the fluid from the inlet opening, the flowpath opening extending axially within the injector body, the flowpath opening having a flowpath cross-sectional size that is different than the inlet cross-sectional size; an outlet opening defined within the injector body at a second axial location along the injector body, the outlet opening in fluid communication with the flowpath opening, such that the outlet opening is configured to receive the fluid from the flowpath opening, wherein the second axial location of the outlet opening is different than the first axial location of the inlet opening; and a gasket disposed in the exterior groove of the second engagement portion, wherein the diameter of the injector body at the engagement portions is larger than the diameter of the injector body between the engagement portions.

16. The water injection assembly of claim 15, wherein the first engagement portion forms a shoulder, and wherein the inlet opening is formed in the shoulder.

17. The water injector assembly of claim 15, wherein the flowpath cross-sectional size is less than the inlet cross-sectional size.

18. The water injector assembly of claim 15, wherein the flowpath opening extends longitudinally within the injector body substantially parallel to the longitudinal axis.

19. The water injector assembly of claim 15, wherein the inlet opening extends into the injector body at an angle with respect to the longitudinal axis.

20. The water injector assembly of claim 19, wherein the angle is non-perpendicular with respect to the longitudinal axis.

21. The water injector assembly of claim 15, wherein the second axial location is disposed between the second engagement portion and the second end.

* * * * *